US011143458B2

(12) United States Patent
Finstad et al.

(10) Patent No.: US 11,143,458 B2
(45) Date of Patent: Oct. 12, 2021

(54) TUBE-FIN HEAT EXCHANGER

(71) Applicant: FLEXENERGY, Portsmouth, NH (US)

(72) Inventors: Brian Finstad, Portsmouth, NH (US); Gary Manter, Portsmouth, NH (US); Christopher David Bolin, Portsmouth, NH (US)

(73) Assignee: FLEXENERGY ENERGY SYSTEMS, INC., Portsmouth, NH (US)

( * ) Notice: Subject to any disclaimer, the term of this patent is extended or adjusted under 35 U.S.C. 154(b) by 25 days.

(21) Appl. No.: 16/371,366

(22) Filed: Apr. 1, 2019

(65) Prior Publication Data

US 2019/0301810 A1 Oct. 3, 2019

Related U.S. Application Data

(60) Provisional application No. 62/651,391, filed on Apr. 2, 2018.

(51) Int. Cl.
*F28D 9/00* (2006.01)
*F28F 3/02* (2006.01)

(52) U.S. Cl.
CPC ..... *F28D 9/0068* (2013.01); *F28D 9/0012* (2013.01); *F28F 3/025* (2013.01); *F28F 2215/08* (2013.01); *F28F 2250/104* (2013.01)

(58) Field of Classification Search
CPC . F28D 7/106; F28D 7/103; F28D 7/10; F28D 9/0068; F28D 9/0012; F28F 3/025; F28F 2250/104; F28F 2215/08
See application file for complete search history.

(56) References Cited

U.S. PATENT DOCUMENTS 2,521,369 A * 9/1950 Holm ..... F25J 5/002 165/141
3,474,513 A * 10/1969 Allingham ..... B21D 53/08 29/890.036

(Continued)

FOREIGN PATENT DOCUMENTS

JP 2012-063067 A 3/2012
KR 10-2017-0110848 A 10/2017

OTHER PUBLICATIONS

Lee, Chang Ho (Authorized Officer), International Search Report and Written Opinion dated Jul. 8, 2019, PCT Application No. PCT/US2019/023369, pp. 1-11.

*Primary Examiner* — Tho V Duong
(74) *Attorney, Agent, or Firm* — MH2 Technology Law Group LLP

(57) ABSTRACT

A heat exchanger includes an outer tube having a first axial end and a second axial end, and a pressure barrier tube positioned generally concentric to and within the outer tube such that a first flowpath is defined axially through at least a portion of the outer tube and radially between the outer tube and the pressure barrier tube. A second flowpath is defined within and at least partially axially through the pressure barrier tube. The heat exchanger also includes a first plurality of fins coupled to and extending between the outer tube and the pressure barrier tube, through the first flowpath, and a second plurality of fins coupled to and extending radially inward from the pressure barrier tube, through the second flowpath. A first fluid in the first flowpath exchanges heat with a second fluid in the second flowpath via heat transfer through the first plurality of fins, the pressure barrier tube, and the second plurality of fins.

9 Claims, 2 Drawing Sheets

(56) References Cited

U.S. PATENT DOCUMENTS

| | | | | | |
|---|---|---|---|---|---|
| 4,059,882 | A * | 11/1977 | Wunder | B21D 53/08 | 29/890.036 |
| 4,096,616 | A * | 6/1978 | Coffinberry | B21D 53/06 | 29/890.036 |
| 4,368,777 | A | 1/1983 | Grasso | | |
| 4,412,509 | A * | 11/1983 | Black | F22B 1/1807 | 122/13.01 |
| 4,633,819 | A * | 1/1987 | Tilliette | F22B 1/066 | 122/32 |
| 5,649,589 | A * | 7/1997 | Carpentier | F28D 7/12 | 165/142 |
| 8,088,344 | B2 | 1/2012 | Te Raa et al. | | |
| 8,171,985 | B2 * | 5/2012 | Valensa | F28D 7/0066 | 165/154 |
| 9,459,052 | B2 * | 10/2016 | Kinder | F28F 13/12 | |
| 2012/0222845 | A1 | 9/2012 | Kinder et al. | | |

* cited by examiner

TUBE-FIN HEAT EXCHANGER

CROSS-REFERENCE TO RELATED APPLICATIONS

This application claims priority to U.S. provisional patent application Ser. No. 62/651,391, which was filed on Apr. 2, 2018 and is incorporated herein by reference in its entirety.

BACKGROUND

There are many types of heat exchangers, tailored for use in a wide variety of thermodynamic systems. One type of heat exchanger is a counter-flow heat exchanger. Counter-flow heat exchanges are sometimes used as recuperators, which may be placed downstream from a compressor, on the cold side, and downstream from a gas turbine on the hot side. The recuperator may be employed to preheat the compressed air being fed to the combustor of the gas turbine. There are many other applications for such counter-flow heat exchangers, as well.

In operation of a counter-flow heat exchanger, the cold fluid flows in an opposite direction (i.e., at about a 180-degree angle) to the flow of hot fluid, in contrast to, for example, a cross-flow heat exchanger, in which the cold and hot fluids proceed at a 90-degree angle to one another. The fluids in the heat exchanger, which may be at different pressures in some thermodynamic systems, may be maintained as separate streams without mixing. Heat transfer is thus effected through a barrier, such as a plate-and-fin arrangement. In general, higher thermal transfer efficiencies can be achieved with the counter-flow heat exchangers, but the design and assembly of such devices is often more complex, and thus generally more expensive than cross-flow designs. Further, special forming processes, and thus forming tools, are often called for in the design of the more-complex heat exchangers, complicating the process of scaling the heat exchangers for different applications.

SUMMARY

Embodiments of the disclosure may provide a heat exchanger that includes an outer tube having a first axial end and a second axial end, and a pressure barrier tube positioned generally concentric to and within the outer tube such that a first flowpath is defined axially through at least a portion of the outer tube and radially between the outer tube and the pressure barrier tube. A second flowpath is defined within and at least partially axially through the pressure barrier tube. The heat exchanger also includes a first plurality of fins coupled to and extending between the outer tube and the pressure barrier tube, through the first flowpath, and a second plurality of fins coupled to and extending radially inward from the pressure barrier tube, through the second flowpath. A first fluid in the first flowpath exchanges heat with a second fluid in the second flowpath via heat transfer through the first plurality of fins, the pressure barrier tube, and the second plurality of fins.

Embodiments of the disclosure may also provide a heat exchanger that includes a housing defining a first fluid inlet, a first fluid outlet, a second fluid inlet, and a second fluid outlet, and a plurality of heat exchanger assemblies. Each assembly includes an outer tube having a first axial end and a second axial end, and a pressure barrier tube positioned generally concentric to and within the outer tube such that a first flowpath is defined axially through at least a portion of the outer tube and radially between the outer tube and the pressure barrier tube, the first flowpath being in communication with the first fluid inlet and the first fluid outlet. A second flowpath is defined within and at least partially axially through the pressure barrier tube, the second flowpath being in communication with the second fluid inlet and the second fluid outlet. The heat exchanger also includes a first plurality of fins coupled to and extending between the outer tube and the pressure barrier tube, through the first flowpath, and a second plurality of fins coupled to and extending radially inward from the pressure barrier tube, through the second flowpath. A first fluid in the first flowpath exchanges heat with a second fluid in the second flowpath via heat transfer through the first plurality of fins, the pressure barrier tube, and the second plurality of fins.

It will be appreciated that the foregoing summary is intended merely to introduce a subset of the features discussed and described below. Accordingly, this summary is not intended to be exhaustive or otherwise limiting.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
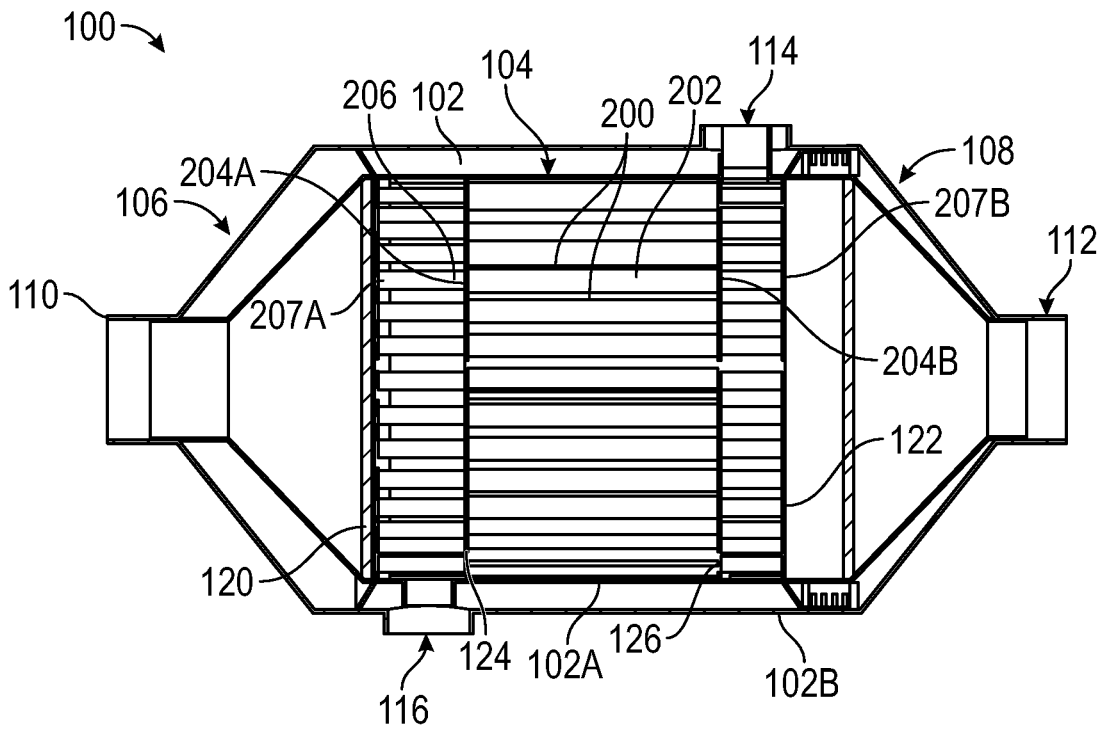
FIG. 1 illustrates a cross-sectional side view of a heat exchanger, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

As used herein, the terms "inner" and "outer"; "up" and "down"; "first" and "second"; "upward" and "downward"; "above" and "below"; "inward" and "outward"; "vertical" and "horizontal"; and other like terms as used herein refer to relative positions and/or directions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

FIG. 1 illustrates a side, cross-sectional view of a heat exchanger 100, according to an embodiment. The heat exchanger 100 may include a housing 102, which may be a metal or alloy (e.g., stainless steel), double-walled vessel, having an inside wall 102A formed within an outside wall 102B. In some embodiments, insulation may be provided between the inside wall 102A and the outside wall 102B, but in other embodiments, such insulation may be omitted. In other embodiments, a single-walled design for the housing 102 may be employed. In a specific embodiment, the housing 102 may include a central, cylindrical section 104 and two conical end sections 106, 108 on either axial side of the central cylindrical section 104.

The housing 102 may define a first fluid inlet 110 and a first fluid outlet 112 at the smaller ends of the two conical end sections 106, 108, respectively. As such, the first fluid inlet 110 and the first fluid outlet 112 may be on opposite axial sides of the housing 102 and may be oriented axially. In other embodiments, the first fluid inlet 110 and the first fluid outlet 112 may be radially oriented, or oriented in any other direction. The housing 102 may also define a second fluid inlet 114 and a second fluid outlet 116. In an embodiment, the second fluid inlet 114 and the second fluid outlet 116 may penetrate radially into the central section 104, but in other embodiments, may be oriented axially or any other direction. The second fluid inlet 114 and the second fluid outlet 116 may be offset axially from one another, such that an axial fluid flow develops at least partially therebetween.

The heat exchanger 100 may also include a series of tube plates, which may be made of metal or alloy (e.g., stainless steel), and which may serve to provide structural support for the internal components of the heat exchanger 100, as well as to direct fluid therein, as will be described in greater detail below. In the illustrated, example embodiment, the heat exchanger 100 may include a first tube plate 120, a second tube plate 122, a third tube plate 124, and a fourth tube plate 126. At least some of the tube plates 120-126 (e.g., the first and second tube plate 120, 122) may be connected to the housing 102 along the peripheries thereof, so as to secure the position thereof with respect to the housing 102. The connection between the housing 102 and any of the tube plates 120-126 may be configured to allow for unequal thermal expansion, as will be described in greater detail below. Further, the tube plates 120-126 may be generally parallel in alignment, may face each other, and may be spaced apart from one another. In a specific embodiment, the third and fourth tube plates 124, 126 may be positioned between the first and second tube plates 120, 122, for purposes of directing and maintaining separate fluid flows, as will be described in greater detail below. Further, the second fluid inlet 114 may be axially between the second and fourth tube plates 122, 126, and the second fluid outlet 116 may be axially between the first and third tube plates 120, 124.

A plurality of heat exchanger assemblies 200 may be positioned within the center section 104, in any pattern. The heat exchanger assemblies 200 may be generally tubular in shape and may extend parallel to one another. The number, size, shape, and configuration of the heat exchanger assemblies 200 may be adjusted to tailor the heat exchanger 100 for different applications. For example, if additional heat exchange surface area is called for, the number of heat exchange assemblies 200 can be increased. If less heat exchange surface area is called for, some of the heat exchanger assemblies 200 can be omitted. In order to view the heat exchanger assemblies 200 in greater detail, reference is now made to FIG. 2, which shows an axial cross-sectional view of one of the heat exchanger assemblies 200.

Each heat exchanger assembly 200 may include an outer tube 202, which may be made of metal or alloy (e.g., stainless steel). A pressure barrier tube 206, also made of metal (e.g., stainless steel), may be positioned within the outer tube 202, and generally concentric thereto. A first flowpath 208 may be defined radially between the outer tube 202 and the pressure barrier tube 206. As such, in some embodiments, the first flowpath 208 may be annular.

A first plurality of fins 210 may be positioned in the first flowpath 208. The fins 210 may be coupled to, e.g., brazed directly to, the outer tube 202 and the pressure barrier 204, and may extend radially therebetween, across the first flowpath 208. The fins 210 may be made, e.g., of stainless steel or another metal or metal alloy. The fins 210 may extend longitudinally (axially) along at least a portion of the pressure barrier tube 206, and, in some embodiments, along an entire axial length of the outer tube 202. The fins 210 may be made from a single sheet, which may be formed into a suitable fin shape, e.g., by bending. The fins 210 may be plain in profile, or may be wavy, louvered, stripped, perforated, or a combination thereof.

In an embodiment, the heat exchanger assembly 200 may include an inner tube 212, which may have a closed or otherwise obstructed interior 214. The inner tube 212 may be made of metal or a metal alloy, such as stainless steel. The inner tube 212 may be positioned generally concentric to the outer tube 202 and the pressure barrier tube 206. Further, a second flowpath 216 may be defined within the pressure barrier tube 206, e.g., radially between the pressure barrier tube 206 and the inner tube 212. As such, in at least some embodiments, the second flowpath 216 may be annular.

A second plurality of fins 218, which may also be stainless steel or another metal or metal alloy, may extend radially inward from the pressure barrier tube 206, through the second flowpath 216. For example, the fins 218 may be coupled to, e.g., brazed directly to, and extend between the pressure barrier 206 and the inner tube 212. The fins 218 may extend longitudinally along at least a portion of the pressure barrier tube 206, and, in some embodiments, along an entire axial length of the inner tube 212. The fins 218 may be made from a single sheet, which may be formed into a suitable fin shape, e.g., by bending. The fins 218 may be plain in profile, or may be wavy, louvered, stripped, perforated, or a combination thereof.

The fins 210, 218 may provide additional surface area for transfer of heat between fluids in the first and second flowpaths 208, 216, with heat traveling in either direction. Accordingly, heat may be transferred, e.g., via the fins 210, the pressure barrier tube 204, and the fins 218 from one fluid to the other. Further, with the illustrated embodiment, the three tubes 202, 206, 212 being generally concentric, each with generally uniform pattern of fins 210, 218 extending therebetween, the heat exchanger assembly 200 may be substantially symmetric about a diameter line, or even substantially point symmetric about the center of the assembly 200. As such, thermal grown may be predictable and manageable in the packaging of the overall heat exchanger 100 (e.g., FIG. 1).

Figure 2:
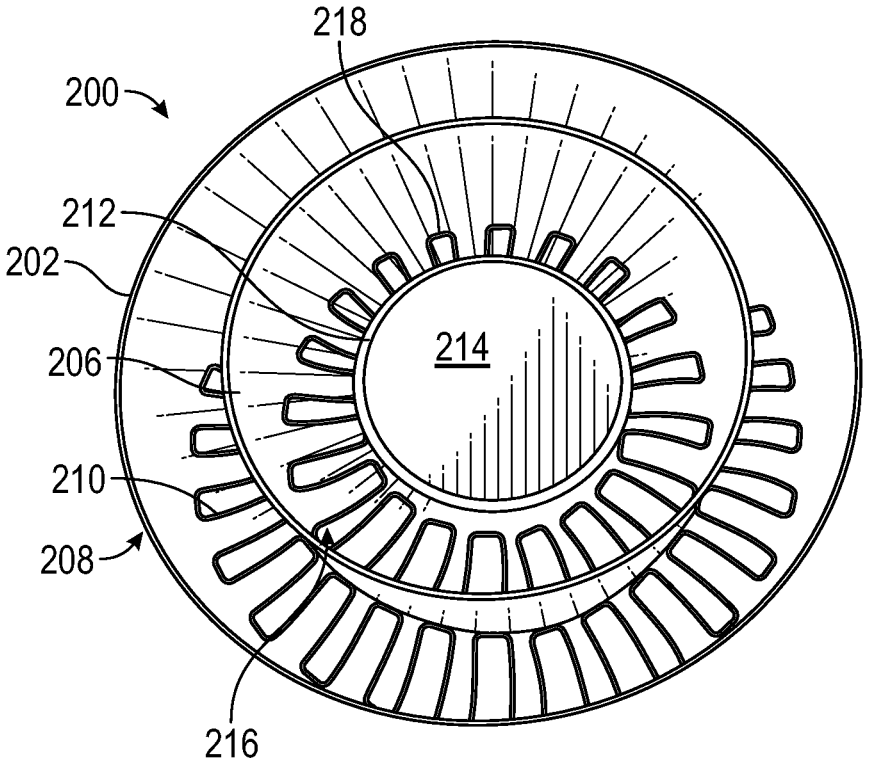
FIG. 2 illustrates a cross-sectional axial view of a heat exchange assembly of the heat exchanger, according to an embodiment.

Referring now to both FIGS. 1 and 2, the connection between the tube plates 120-126 may be appreciated. The connection will be described for one of the heat exchanger assemblies 200, with it being understood that the other heat exchanger assemblies 200 may be similarly configured, or may be configured in any other suitable way.

In particular, as illustrated, the pressure barrier tube 206 may extend between the first and second tube plates 120, 122, and may be coupled thereto, such that the tube plates 120, 122 at least partially maintain a position of the heat exchanger 100 within the housing 102. An open end 207A of the pressure barrier tube 206 may be aligned with an opening in the first tube plate 120, and the opposite end 207B, which may also be open, may be aligned within an opening in the second tube plate 122. As such, fluid is able to flow from the first fluid inlet 110, and into the second flowpath 216 defined in the pressure barrier tube 206. The second flowpath 216 may proceed through the pressure barrier tube 206, and may allow fluid to exit therefrom, through the second tube plate 122. Fluid may then proceed to the first fluid outlet 112. As such, the fluid that enters through the first fluid inlet 110 that proceeds in the second flowpath 216 may be prevented from entering the first flowpath 208.

Furthermore, the outer tube 202 may extend between the third and fourth tube plates 124, 126 and may be coupled thereto, such that the third and fourth tube plates 124, 126 may at least partially maintain a position of the heat exchanger 100 within the housing 102. An open end 204B of the outer tube 202 may be aligned with and/or extend through openings formed in the fourth plate 126. As such, fluid may flow into the housing 102 via the second fluid inlet 114, and may be directed into the first flowpath 208. The fluid may be prevented from proceeding into the second flowpath 216, as the pressure barrier tube 206 extends between the fourth and second tube plates 126, 122, while the fluid may be prevented from proceeding around the outside of the outer tube 202 by the fourth tube plate 126. Thus, fluid moves into the first flowpath 208, courses therethrough, and exits the heat exchanger assembly 200 via another open axial end 204B of the outer tube 202, where the outer tube 202 meets and penetrates the third tube plate 124. Fluid is again prevented from entering the second flowpath 216 by the pressure barrier tube 206 extending between the first and third tube plates 120, 124, and is directed between the first and third tube plates 120, 124 through the second fluid outlet 116.

Thus, a counter-flow heat exchange arrangement is developed within each of the heat exchanger assemblies 200. Two separate fluids (one relatively hot, one relative cold) may proceed through the two separate inlets 110, 114, and may exchange heat within the heat exchanger assemblies 200, as the fluids proceed in opposite axial directions. The pressure barrier tube 206 and the tube plates 120-124 prevent the two fluids from mixing, while the fins 210, 218 and the pressure barrier tube 206 conduct heat therebetween. Fluid in either of the first or second flowpaths 208, 216 may be the hot fluid, and thus heat may be conducted in either direction (radially inward or radially outward). The obstructed interior 214 of the inner tube 212 may serve to force the fluid in the second flowpath 216 radially outwards, toward the pressure barrier tube 206, to enhance heat transfer efficiency.

Figure 3:
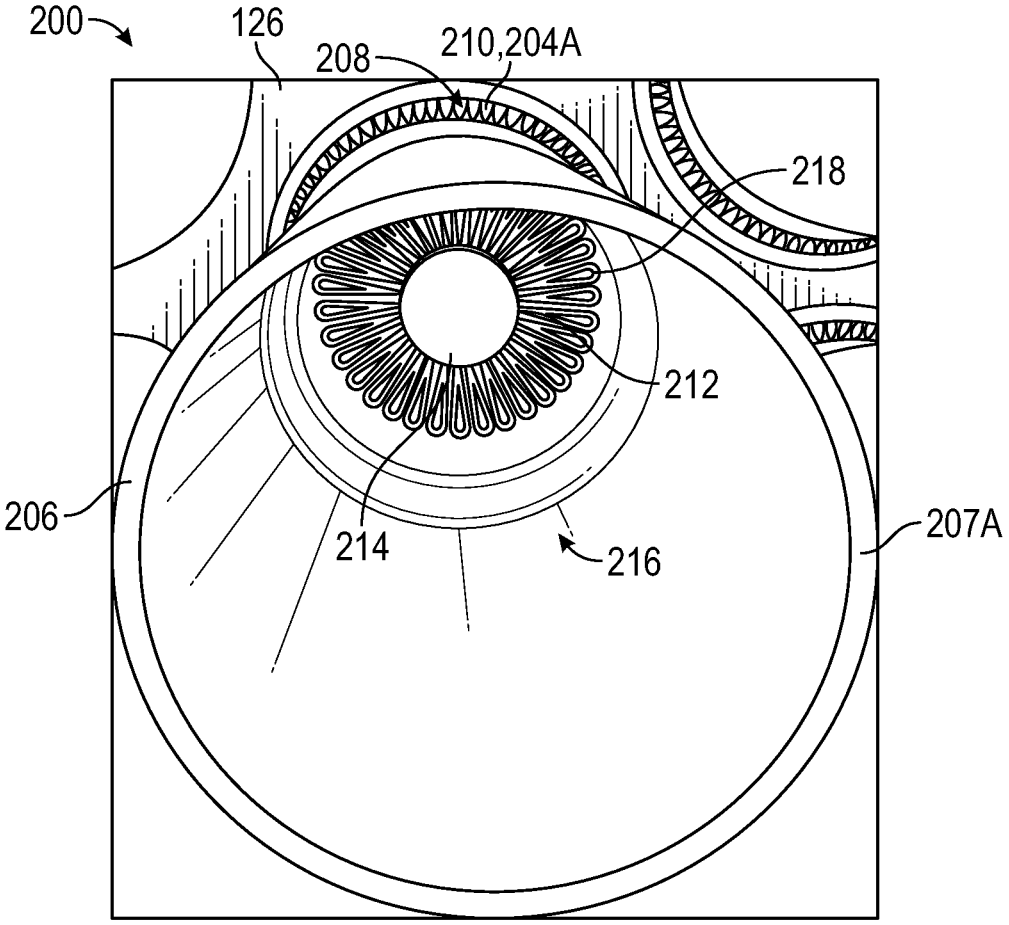
FIG. 3 illustrates an end view of the heat exchange assembly, according to an embodiment.

As mentioned above, the pressure barrier tube 206 may extend through the, e.g., third tube plate 124, while the outer tube 202 may be coupled thereto and configured to receive fluid through the third tube plate 124. FIG. 3 illustrates an end view of an example of the assembly 200. As shown, the pressure tube 206 extends past the third tube plate 124, terminating with the first tube plate 120 (not shown in this view). Fluid thus flows axially in the pressure barrier tube 206, toward the fins 218 in the second flowpath 216. The fins 218 (and the inner tube 212) may stop at the third tube plate 124, or may extend entirely along the length of the pressure barrier tube 206. As can also be seen, the entrance to the first flowpath 208, around the outside of the pressure barrier tube 206 and within the outer tube 202 is located where the outer tube 202 meets the third tube plate 126, allowing fluid to exit therefrom. The view looking at the fourth tube plate 126 may be substantially the same for the opposite end of the heat exchanger assembly 200.

Figure 4:
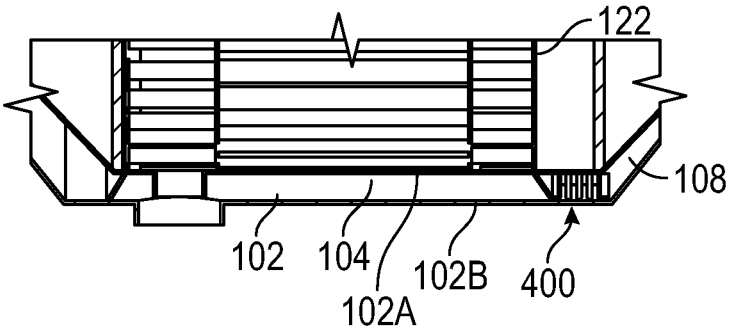
FIG. 4 illustrates an enlarged view of a portion of FIG. 1, showing a thermal expansion connection for a tube plate of the heat exchanger, according to an embodiment.

FIG. 4 illustrates a cross-sectional view of a portion of the heat exchanger 100, specifically illustrating a thermal expansion connection 400 between the second tube plate 120 and the housing 102, according to an embodiment. The expansion connection 400 may be configured to allow for a range of positions for the second tube plate 122 relative to the housing 102, while still supporting the second tube plate 122 within the housing 102. For example, the heat exchangers assemblies 200 may experience a different amount of thermal expansion than the housing 102. As such, the position of the tube plate 122 may change with respect to the housing 102 to accommodate such change in size of the heat exchanger assemblies 200. The expansion connection 400 allows for such unequal expansion to avoid damaging the components of the heat exchanger 100. An expansion connection similar to the expansion connection 400 may also be provided for the first tube plate 120 (or, alternatively or additionally, for the third and/or fourth tube plates 124, 126). In an embodiment, the expansion connection 400 may be a bellows, in which turns or crimps are attached on one end to the second tube plate 122, and attached to the housing 102 at an opposite end. Various other types of expansion connections 400 may also be used.

Referring again to FIGS. 1-3, operation of the heat exchanger 100 may include receiving a first fluid through the first fluid inlet 110, and receiving a second fluid through the second fluid inlet 114. The first fluid may be directed through the conical section 106, which serves as a manifold or header for the heat exchanger assemblies 200. The first fluid may then be directed into the pressure barrier tube 206 by the first tube plate 120, which blocks fluid flow therepast, except through the pressure barrier tubes 206 of the heat exchanger assemblies 200. The first fluid may thus proceed into heat exchanger assemblies 200, specifically, the second flowpaths 216, engaging the fins 218, which may be disposed all or along at least a portion of the second flowpath 216.

At the same time, the second fluid may flow between the second and fourth tube plates 122, 126. As such, the second fluid may proceed into the first flowpath 208, outside of the pressure barrier tube 206, of each of the heat exchanger assemblies 200. In the first flowpath 208, the second fluid may engage the fins 210.

As the first and second fluids proceed through their respective flowpaths 216, 208, in opposite axial directions, the fluids may contact the pressure barrier tube 206 and/or the fins 210, 218. This may result in the hotter of the two fluids transferring heat via conduction through the pressure barrier tube 206 and the fins 210, 218, into the cooler of the two fluids, thereby effecting the desired, counter-flow heat exchange.

Accordingly, it will be seen that in embodiments of the present disclosure, a heat exchanger is provided in which counter-flow heat exchange is effected. Further, the fin direction for the heat exchanger assemblies is parallel with the tube axis (e.g., they extend along the axial flowpaths), and the fins are located on both the internal and external sides of the pressure barrier tube. In addition, this arrangement allows the fins to be made in a variety of styles (wavy, louvered, strip, perforated, plain, etc.) and are manufacturable at different thickness for different applications. Embodiments of the disclosure may also provide scalability. The heat exchanger can be tailored for specific applications by adjusting fin details (e.g., height, fins/inch, thickness, flow length, etc.); tube size (e.g., diameter of pressure boundary tube); and/or the number of heat exchange assemblies.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A heat exchanger, comprising:

a housing defining a first fluid inlet, a first fluid outlet, a second fluid inlet, and a second fluid outlet;

a plurality of heat exchanger assemblies, each comprising:

an outer tube having a first axial end and a second axial end;

an inner tube positioned within and generally concentric to the outer tube, the inner tube being blocked so as to prevent fluid flow therethrough, and the inner tube having a first axial end and a second axial end;

a pressure barrier tube positioned radially between the inner tube and outer tube, wherein the pressure barrier tube extends axially outward beyond the first and second axial ends of the outer tube, and axially beyond the first and second axial ends of the inner tube, wherein a first flowpath is defined axially through at least a portion of the outer tube and radially between the outer tube and the pressure barrier tube, the first flowpath being in communication with the second fluid inlet and the second fluid outlet, and wherein a second flowpath is defined within and at least partially axially through the pressure barrier tube and radially between the pressure barrier tube and the inner tube, the second flowpath being in communication with the first fluid inlet and the first fluid outlet;

a first plurality of fins extending at least partially between the outer tube and the pressure barrier tube, through the first flowpath; and a second plurality of fins extending radially inward from the pressure barrier tube, through the second flowpath, wherein a first fluid in the first flowpath exchanges heat with a second fluid in the second flowpath via heat transfer through the first plurality of fins, the pressure barrier tube, and the second plurality of fins;

a first tube plate;

a second tube plate, the pressure barrier tube of each of the heat exchanger assemblies extending to the first and second tube plates, and the inner tube of each of the heat exchanger assemblies and the outer tube of each of the heat exchanger assemblies being spaced apart from the first and second tube plates;

a third tube plate; and a fourth tube plate, the third and fourth tube plates being between the first and second tube plates, the pressure barrier tube of each of the heat exchanger assemblies extending through the third and fourth tube plates, the inner tube of each of the heat exchanger assemblies and the outer tube of each of the heat exchanger assemblies extending to third and fourth tube plates.

2. The heat exchanger of claim 1, wherein the pressure barrier tube of each of the heat exchanger assemblies is coupled to and receives the second fluid from the first fluid inlet and into the second flowpath through the first tube plate, and wherein the first tube plate blocks the second fluid from entering the first flowpath.

3. The heat exchanger of claim 2, wherein the pressure barrier tube of each of the heat exchanger assemblies is coupled to and provides the second fluid from the second flowpath through the second tube plate, to the first fluid outlet, and wherein the second tube plate blocks the first fluid from entering the first fluid outlet.

4. The heat exchanger of claim 3, wherein the outer tube is spaced axially apart from the first and second tube plates, and wherein the second fluid inlet and the second fluid outlet are positioned between the first and second tube plates.

5. The heat exchanger of claim 1, wherein an inlet to the first flowpath is at least partially between the second tube plate and the fourth tube plate, and an outlet of the second flowpath is outside of the second tube plate.

6. The heat exchanger of claim 1, wherein the first plurality of fins is brazed together with the outer tube.

7. The heat exchanger of claim 6, wherein the second plurality of fins is brazed together with the inner tube.

8. A heat exchanger, comprising:

a housing comprising:

a first axial end portion;

a second axial end portion, wherein the first and second axial end portions are at least partially conical;

an intermediate portion between the first and second axial end portions;

a first fluid inlet through the first axial end portion;

a second fluid inlet through the intermediate portion;

a first fluid outlet through the second axial end portion; and a second fluid outlet through the intermediate portion;

a plurality of heat exchanger assemblies positioned in the housing, each heat exchanger assembly including:

an outer tube positioned at least partially within the housing and having a first axial end and a second axial end;

a pressure barrier tube positioned at least partially within the outer tube, wherein a first flowpath extends from the second fluid inlet, between the outer tube and the pressure barrier tube, and to the second fluid outlet, and wherein the first flowpath is configured to have a first fluid flow therethrough;

an inner tube positioned at least partially within the outer tube and having a first axial end and a second axial end, wherein the outer tube, the pressure barrier tube, and the inner tube are substantially concentric with one another, wherein a second flowpath extends from the first fluid inlet, between the pressure barrier tube and the inner tube, and to the first fluid outlet, and wherein the second flowpath is configured to have a second fluid flow therethrough, the inner tube being blocked so as to prevent fluid flow therethrough, and the inner tube having a first axial end and a second axial end, wherein the pressure barrier tube extends axially outward beyond the first and second axial ends of the outer tube, and axially beyond the first and second axial ends of the inner tube;

a first plurality of fins extending radially between the outer tube and the pressure barrier tube; and a second plurality of fins extending radially between the pressure barrier tube and the inner tube, wherein the first fluid in the first flowpath exchanges heat with the second fluid in the second flowpath via heat transfer through the pressure barrier tube, the first plurality of fins, and the second plurality of fins;

a first tube plate;

a second tube plate, wherein the pressure barrier tube of each of the heat exchanger assemblies is coupled to and extends axially between the first and second tube plates and the inner tube of each of the heat exchanger assemblies and the outer tube of each of the heat exchanger assemblies being spaced apart from the first and second tube plates, wherein a first opening in the pressure barrier tube is aligned with an opening in the first tube plate, and wherein a second opening in the pressure barrier tube is aligned with an opening in the second tube plate;

a third tube plate; and a fourth tube plate, wherein the third and fourth tube plates are positioned between the first and second tube plates, wherein the second fluid inlet is positioned between the second and fourth tube plates, wherein the second fluid outlet is positioned between the first and third tube plates, wherein the outer tube is coupled to and extends axially between the third and fourth tube plates, wherein a first opening in the outer tube is aligned with an opening in the third tube plate, wherein a second opening in the outer tube is aligned with an opening in the fourth tube plate, wherein the pressure barrier tube of each of the heat exchanger assemblies extends through the third and fourth tube plates, and wherein the inner tube of each of the heat exchanger assemblies and the outer tube of each of the heat exchanger assemblies extend to the third and fourth tube plates.

9. The heat exchanger of claim 1, further comprising an expansion connection that couples together second tube plate and the housing, the expansion connection being configured to resiliently deflect so as to permit thermal expansion of the pressure barrier tube.

* * * * *